US006589390B1

(12) United States Patent
Mayer

(10) Patent No.: US 6,589,390 B1
(45) Date of Patent: Jul. 8, 2003

(54) PRESS SECTION AND PROCESS FOR GUIDING A FIBER MATERIAL WEB THROUGH THE PRESS SECTION

(75) Inventor: Wolfgang Mayer, Heidenheim (DE)

(73) Assignee: Voith Sulser Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/231,672

(22) Filed: Jan. 15, 1999

(30) Foreign Application Priority Data

Jan. 20, 1998 (DE) ..... 198 01 891

(51) Int. Cl.[7] ..... D21F 11/00

(52) U.S. Cl. ..... 162/205; 162/203; 162/204; 162/351; 162/358.3; 162/360.2; 162/360.3

(58) Field of Search ..... 162/351, 358.3, 162/360.2, 360.3, 203, 204, 205

(56) References Cited

U.S. PATENT DOCUMENTS

| | | | | |
|---|---|---|---|---|
| 5,389,205 A | | 2/1995 | Pajula et al. | |
| 5,611,893 A | | 3/1997 | Pajula et al. | |
| 5,650,049 A | | 7/1997 | Kivimaa et al. | |
| 5,868,904 A | * | 2/1999 | Laapotti | 162/360.3 |
| 6,090,244 A | | 7/2000 | Kotitschke | |

FOREIGN PATENT DOCUMENTS

| | | |
|---|---|---|
| DE | 29701382 | 4/1997 |
| DE | 29701948 | 5/1997 |
| DE | 19708967 | 9/1998 |
| EP | 0770727 | 5/1997 |
| WO | 97/13030 | 4/1997 |

* cited by examiner

*Primary Examiner*—Steven P. Griffin
*Assistant Examiner*—Dionne A. Walls
(74) *Attorney, Agent, or Firm*—Greenblum & Bernstein, P.L.C.

(57) ABSTRACT

Press section of a machine for producing a fiber material, web and process for guiding a fiber material web through the press section. The press section includes at least two double-felted presses arranged in series in a travel direction of the fiber material web. An upstream one of the at least two double-felted presses may include a deflection-controlled shoe press roll and a suction roll, and the deflection-controlled shoe press roll and the suction roll may be arranged to form an upstream press nip. The process may include guiding the fiber material web through a press nip of an upstream one of the at least two double-felted presses formed by a deflection-controlled shoe press roll and a suction roll.

20 Claims, 1 Drawing Sheet

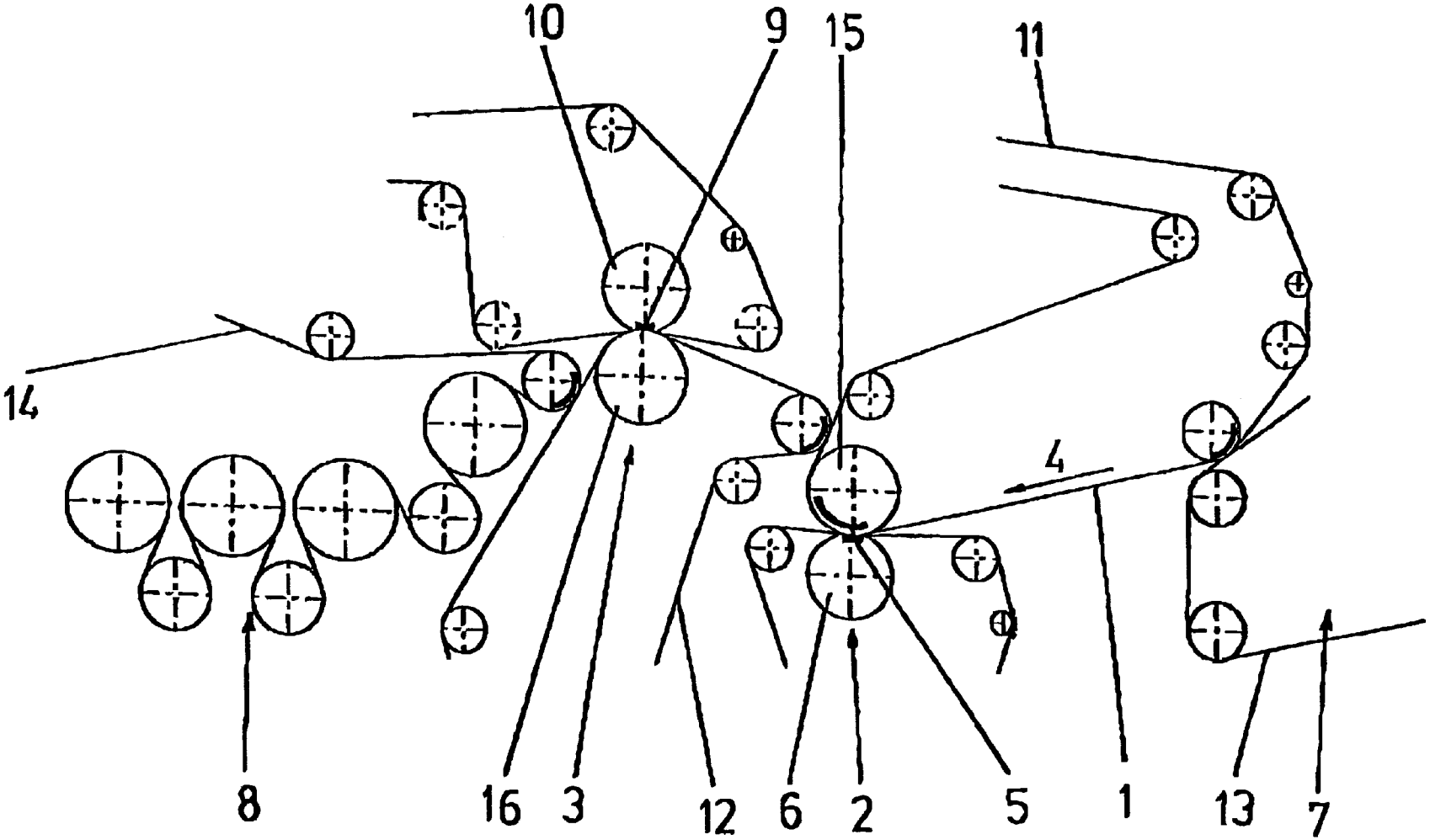
7
13
1
4
11
5
2
15
6
9
12
3
10
16
8
14

PRESS SECTION AND PROCESS FOR GUIDING A FIBER MATERIAL WEB THROUGH THE PRESS SECTION

CROSS-REFERENCE TO RELATED APPLICATIONS

The present application claims priority under 35 U.S.C. §119 of German Patent Application No. 198 01 891.6, filed on Jan. 20, 1998, the disclosure of which is expressly incorporated by reference herein in its entirety.

BACKGROUND OF THE INVENTION

1. Field of the Invention

The present invention relates to a press section of a machine for producing a fiber material web, e.g., a paper and/or cardboard web, and a process for guiding the fiber material web through the press section. The press section includes at least two double-felted presses in series.

2. Discussion of Background Information

Press sections similar in general to the above-noted press section are utilized to drain fiber material webs, and include shoe presses formed with a concave contact pressure surface to form an elongated press nip (gap) with a cylindrical mating roll. Such press nips can significantly improve drainage performance.

However, because of the high water content of the fiber material web, problems arise in removing the water pressed out in the first, or upstream, press nip.

SUMMARY OF THE INVENTION

The present invention provides a simply structured press section having improved drainage in the first, i.e., upstream, press nip relative to a web travel direction.

The present invention provides an upstream press nip, ie., relative to the web travel direction, formed by a deflection-adjustment shoe roll and a suction roll.

The shoe press rolls may be generally formed of a flexible press jacket guided over or across a press element having concave contact pressure surfaces. This arrangement permits an elongated press tip to be formed with a cylindrical mating roll. In this manner, the fiber material web in the press nip is exposed to press pressure over a longer distance and, therefore, is more intensely drained Additionally, the pressure in the press nip is not started abruptly, rather, the pressure can be raised continuously, e.g., from a low value to a higher value.

Drainage felts may be positioned on both sides of the fiber material web to provide adequate capacity for absorbing the water pressed out of the fiber material web, and even-sidedness of the fiber material web. Moreover, by utilizing a suction roll in the upstream, or first, press nip, the absorption capacity for the water pressed out of the fiber material web may be significantly increased.

Particularly at high speeds, it may be advantageous for the fiber material web to be supported by at least on belt, sieve (screen), felt, or similar device, starting from the transfer from an upstream unit until delivery to a downstream unit. This leads to secure guidance of the web and thereby reduces the frequency of web breakages.

Additionally, drainage performance of the press section can be further improved if the double-felted press nip positioned downstream, i.e., in web travel direction, is formed at least by one deflection-controlled roll, e.g., a shoe press roll. In this manner, it is possible to limit the press section to two press nips, which reduces cost considerably.

Guidance of the fiber material web can be achieved by one drainage felt of the press nip. It may be particularly advantageous in this case for a drainage felt of the first press to take off the fiber material web from an upstream sieve (screen) section and for the drainage felt, located on the other side of the fiber material web, of the downstream press to take off the fiber material web from the drainage felt of the first press, and transfer it to the downstream drying section.

To ensure secure guidance of the web and to reduce remoistening of the press nip, it may be further advantageous for the drainage felt of the first press that guides the fiber material web to run around the suction roll.

Accordingly, the present invention is directed to a press section of a machine for producing a fiber material web. The press section includes at least two double-felted presses arranged in series in a travel direction of the fiber material web. An upstream one of the at least two double-felted presses may include a deflection-controlled shoe press roll and a suction roll, and the deflection-controlled shoe press roll and the suction roll may be arranged to form an upstream press nip.

In accordance with another feature of the present invention, the at least two double-felted presses may be arranged such that the fiber material web is supported by at least one support belt between a transfer point from an upstream unit to a transfer point to a downstream unit. Further, the at least one support belt may include at least one of a belt, sieve, and felt.

In accordance with still another feature of the present invention, the press section may include only two press nips. Further, the at least two double-felted presses may be arranged such that the fiber material web is supportably guided through the press section by at least one drainage felt. Further, a drainage felt of the upstream press may be adapted to receive the fiber material web from an upstream sieve section and a drainage felt of a downstream one of the at least two double-felted presses, arranged on a side of the fiber material web opposite the drainage felt of the upstream press, may be adapted to receive the fiber material web from the drainage felt of the upstream press and to transfer the fiber material web to a downstream drying section. Further, the drainage felt of the upstream press may be adapted to guide the fiber material web around the suction roll.

In accordance with a further feature of the present invention, the fiber material web may include at least one of a paper and cardboard web.

The present invention is also directed to a process of guiding a fiber material web through a press section of a web producing machine that includes at least two double-felted presses arranged in series in a travel direction of the fiber material web. The process may include guiding the fiber material web through a press nip of an upstream one of the at least two double-felted presses formed by a deflection-controlled shoe press roll and a suction roll.

In accordance with another feature of the present invention, the process may further include supporting the fiber material web by at least one support belt between a transfer point from an upstream unit to a transfer point to a downstream unit. Further, the at least one support belt may include at least one of a belt, sieve, and felt. The process may also include continuously supporting the fiber material web by at least one support belt between a transfer point from an upstream unit to a transfer point to a downstream unit.

In accordance with still another feature of the present invention, the process may further include guiding the fiber material web through a downstream one of the at least two double-felted presses, which is composed of a deflection-controlled roll.

In accordance with a further feature of the present invention, the process may further include guiding the fiber material web through only two press nips in the press section. Further, the process may further include supportably guiding the fiber material web through the press section by at least one drainage felt. Further, the process may further include receiving the fiber material web on a drainage felt of the upstream press from an upstream sieve section, receiving the fiber material web on a drainage felt of a downstream one of the at least two double-felted presses, which is arranged on a side of the fiber material web opposite the drainage felt of the upstream press, from the drainage felt of the upstream press, and transferring the fiber material web to a downstream drying section. Still further, the process may further include guiding the fiber material web around the suction roll on the drainage felt of the upstream press.

In accordance with yet another feature of the present invention, the fiber material web may include at least one of a paper and cardboard web.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention in which like reference numerals represent similar parts throughout the several views of the drawings, and wherein;

The FIGURE illustrates an exemplary embodiment of a press section in accordance with the features of the present invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspect of the present invention. In this regard, no attempt is made to show structural details of the present invention in more detailed than is necessary for the fundamental understanding of the present invention, the description taken with the drawings making apparent to those skilled in the art how the several forms of the present invention may be embodied in practice.

In the FIGURE, a schematic view of a press section composed of two presses 2 and 3, which include press nips 5 and 9, respectively, is illustrated. Continuous drainage felts 11 and 12 are guided around rolls 6 and 15 and rolls 10 and 16, which form press nips 5 and 9, respectively. Continuous drainage felts 11 and 12 are provided to absorb water that is pressed out a fibrous material web passing through press nips 5 and 9. Additionally, each of the presses 2 and 3 may be formed to include a deflection-controlled (-adjustment) shoe press roll 6 and 10, respectively. While press nip 5 of press 2 is positioned upstream ie., relative to a web travel direction 4 of a fiber material web 1, the opposing (counter) roll 15 is composed of a cylindrical suction roll 15. In downstream press 3, opposing (counter) roll 16 is composed of a cylindrical smooth roll.

Deflection-controlled shoe press rolls 6 and 10 provide an adjustable and, preferably, substantially even drainage cross-profile along each press nip 5 and 9. By utilizing drainage felt 11 and 12 in press nip 5 and 9, respectively, an adequately large capacity for absorbing the water that is pressed out may be provided. Moreover, fiber material web 1 can be guided through the press section supported by one drainage felt 11 and 12.

Suction roll 15 may include a perforated roll jacket, and a inside of the roll jacket may be coupled to a suction or vacuum source. The negative pressure, which is provided in a suction region of suction roll 15 that is arranged to extend beyond first press nip 5, provides not only secure guidance of fiber material web 1 on drainage felt 11 around part of suction roll 15 and over the suction region of roll 15 after leaving first press nip 5, on but also provides reduced remoistening of fiber material web 1 through drainage felt 11.

To ensure secure guidance of fiber material web 1, fiber material web 1 may be removed (lifted off) directly from a sieve (screen) 13 of an upstream unit 7. This lift off may be facilitated by a suction guide roll that guides drainage felt 11 toward suction roll 15 of first press 2. After being guided through first press nip 5, fiber material web 1 may be transferred onto drainage felt 12 via another suction guide roll, around which drainage felt 12 is guided. Drainage felt 12 may be guided over smooth roll 16 to deliver fiber material web 1 to a drying sieve (screen) 14 of a downstream unit 8. The transfer from drainage felt 12 to drying sieve 14 may be facilitated by another suction guide roll. Unit 8 may be, e.g., a dryer section, in which fiber material web 1 as well as drying sieve 14 may be guided alternately across or over a plurality of dryer cylinders (drums) and guide rolls.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A press section of a machine for producing a fiber material web comprising:

at least two double-felted presses arranged in series in a travel direction of the fiber material web;

an upstream one of the at least two double-felted presses comprising a deflection-controlled shoe press roll and a suction roll; and the deflection-controlled shoe press roll and the suction roll being arranged to form the upstream press nip, and the suction roll having a suction zone arranged to extend, in a downstream direction, beyond the upstream press nip; and the web and one of the felts of the upstream double-felted press being guided around the suction roll and over the suction region downstream of the upstream press nip.

2. The press section in accordance with claim 1, the at least two double-felted presses being arranged such that the fiber material web is supported by at least one support belt between transfer point from an upstream unit to a transfer point to a downstream unit.

3. The press section in accordance with claim 2, the at least one support belt comprising at least one of a belt, sieve, and felt.

4. The press section in accordance with claim 1, a downstream one of the at least two double-felted presses comprising a deflection-controlled roll.

5. The press section in accordance with claim 4, the deflection-controlled roll comprising a shoe press roll.

6. The press section in accordance with claim 1, the press section composed of only two press nips.

7. The press section in accordance with claim 6, the at least two double-felted presses arranged such that the fiber material web is supportably guided through the press section by at least one drainage felt.

8. The press section in accordance with claim 7, a drainage felt of the upstream press being adapted to receive the fiber material web from an upstream sieve section; and a drainage felt of a downstream one of the at least two double-felted presses, arranged on a side of the fiber material web opposite the drainage felt of the upstream press, being adapted to receive the fiber material web from the drainage felt of the upstream press and to transfer the fiber material web to a downstream drying section.

9. The press section in accordance with claim 8, the drainage felt of the upstream press being adapted to guide the fiber material web around the suction roll.

10. The press section in accordance with claim 1, the fiber material web comprising at least one of a paper and cardboard web.

11. A process of guiding a fiber material web through a press section of a web producing machine that includes at least two double-felted presses arranged in series in a travel direction of the fiber material web, the process comprising:

guiding the fiber material web through a press nip of an upstream one of the at least two double-felted presses formed by a deflection-controlled shoe press roll and a suction roll, wherein the suction roll has a suction zone arranged to extend, in a downstream direction, beyond the upstream press nip, and guiding the fiber material web and one of the felts of the upstream double-felted press around the suction roll and over the suction zone downstream of the upstream press nip.

12. The process in accordance with claim 11, further comprising:

supporting the fiber material web by at least one support belt between a transfer point from an upstream unit to transfer point to a downstream unit.

13. The process in accordance with claim 12, wherein the at least one support belt comprising at least one of a belt, sieve, and felt.

14. The process in accordance with claim 12, further comprising:

continuously supporting the fiber material web by at least one support belt between a transfer point from an upstream unit to a transfer point to a downstream unit.

15. The process in accordance with claim 11, further comprising:

guiding the fiber material web through a downstream one of the at least two double-felted presses, which is composed of a deflection-controlled roll.

16. The process in accordance with claim 11, further comprising:

guiding the fiber material web through only two press nips in the press section.

17. The process in accordance with claim 16, further comprising:

supportably guiding the fiber material web through the press section by at least one drainage felt.

18. The process in accordance with claim 17, further comprising:

receiving the fiber material web on a drainage felt of the upstream press from an upstream sieve section;

receiving the fiber material web on a drainage felt of a downstream one of the at least two double-felted presses, which is arranged on a side of the fiber material web opposite the drainage felt of the upstream press, from the drainage felt of the upstream press; and transferring the fiber material web to a downstream drying section.

19. The process in accordance with claim 18, further comprising:

guiding the fiber material web around the suction roll on the drainage felt of the upstream press.

20. The process in accordance with claim 11, wherein the fiber material web comprises at least one of a paper and cardboard web.

* * * * *